US010714832B2

(12) United States Patent
Bakalski

(10) Patent No.: US 10,714,832 B2
(45) Date of Patent: Jul. 14, 2020

(54) ANTENNA TUNING CIRCUIT, METHOD FOR TUNING AN ANTENNA, ANTENNA ARRANGEMENT AND METHOD FOR OPERATING THE SAME

(71) Applicant: Infineon Technologies AG, Neubiberg (DE)

(72) Inventor: Winfried Bakalski, Munich (DE)

(73) Assignee: Infineon Technologies AG, Neubiberg (DE)

( * ) Notice: Subject to any disclaimer, the term of this patent is extended or adjusted under 35 U.S.C. 154(b) by 29 days.

(21) Appl. No.: 15/643,337

(22) Filed: Jul. 6, 2017

(65) Prior Publication Data

US 2017/0310007 A1 Oct. 26, 2017

Related U.S. Application Data

(63) Continuation of application No. 13/922,080, filed on Jun. 19, 2013, now abandoned.

(51) Int. Cl.

| | |
|---|---|
| ***H01Q 1/48*** | (2006.01) |
| ***H01Q 5/314*** | (2015.01) |
| ***H01Q 9/04*** | (2006.01) |

(52) U.S. Cl.

CPC ..... *H01Q 5/314* (2015.01); *H01Q 9/0421* (2013.01)

(58) Field of Classification Search

None

See application file for complete search history.

(56) References Cited

U.S. PATENT DOCUMENTS

| | | | | |
|---|---|---|---|---|
| 5,794,158 | A | 8/1998 | Itoh | |
| 6,765,540 | B2 | 7/2004 | Toncich | |
| 7,786,819 | B2 | 8/2010 | Ella et al. | |
| 9,041,617 | B2 | 5/2015 | Sorenson et al. | |
| 9,584,097 | B2 * | 2/2017 | Bakalski | H03H 11/28 |
| 2004/0041734 | A1 | 3/2004 | Shiotsu et al. | |
| 2004/0263411 | A1 | 12/2004 | Fabrega-Sanchez et al. | |
| 2006/0176777 | A1 | 8/2006 | Ihara | |
| 2006/0279469 | A1 * | 12/2006 | Adachi | H01Q 1/22 343/767 |
| 2008/0258984 | A1 * | 10/2008 | Adachi | H01Q 1/22 343/745 |

(Continued)

FOREIGN PATENT DOCUMENTS

| | | | |
|---|---|---|---|
| CN | 202978926 | U | 6/2013 |
| DE | 69600797 | T2 | 3/1999 |

(Continued)

OTHER PUBLICATIONS

Antenna (Radio) from Wikipedia, the free encyclopedia, 2 pages (pp. 1 and 14 of 37 pgs), hittps://en.wikipedia.org/wiki/antenna(Radio), printed out May 20, 2016.

(Continued)

*Primary Examiner* — Trinh V Dinh
(74) *Attorney, Agent, or Firm* — Slater Matsil, LLP

(57) ABSTRACT

An antenna tuning circuit is provided. The antenna tuning circuit includes an antenna, an inductor and a variable capacitor. The antenna includes a first terminal, which serves as a feed terminal, and a second terminal, which is separate from the first terminal. The inductor and the variable capacitor are coupled to the second terminal, to tune the antenna.

17 Claims, 18 Drawing Sheets

(56) References Cited

U.S. PATENT DOCUMENTS

2008/0305750 A1 12/2008 Alon et al.
2009/0051610 A1* 2/2009 Sugiyama ..... H01Q 9/4021 343/745
2009/0073064 A1 3/2009 Russo et al.
2010/0053007 A1* 3/2010 Ni ..... H01Q 9/0421 343/745
2010/0207703 A1 8/2010 Dupuy et al.
2010/0279734 A1 11/2010 Karkinen et al.
2011/0299438 A1* 12/2011 Mikhemar ..... H04B 1/0458 370/280
2011/0301450 A1 12/2011 Hue et al.
2012/0009889 A1 1/2012 Morgan et al.
2012/0119955 A1 5/2012 Milosavljevic et al.
2012/0306718 A1 12/2012 Koyanagi et al.
2012/0319918 A1 12/2012 Ramachandran et al.
2013/0113677 A1 5/2013 Boyle et al.
2013/0154897 A1 6/2013 Sorensen et al.
2013/0194139 A1* 8/2013 Nickel ..... H01Q 5/328 343/703
2013/0328734 A1* 12/2013 Thind ..... H03H 7/40 343/745
2014/0070984 A1* 3/2014 Rofougaran ..... H01G 5/16 342/200
2014/0266962 A1 9/2014 Dupuy et al.
2014/0306855 A1 10/2014 Tsai et al.
2014/0333496 A1 11/2014 Hu et al.
2014/0375514 A1* 12/2014 Bakalski ..... H01Q 5/314 343/745
2015/0235971 A1 8/2015 Smith et al.
2016/0336643 A1 11/2016 Pascolini et al.

FOREIGN PATENT DOCUMENTS

EP 0526643 A1 2/1993
EP 2461422 A1 6/2012
WO 2012158693 A1 11/2012

OTHER PUBLICATIONS

Antenna Basics from Rohde&Schwarrz, 4 pages (pp. 1, 2, 7, 15), Nov. 1999.
Basic Antenna from Digi-Key Electronics, 2 pages (pp. 1 and 2 of 3 pgs), https://electricinatraining.tpub.com/14182/css/Basic-Antennas-184.htm, printed out May 20, 2016.

* cited by examiner

Test-Case Results (700MHz, 34dBm, VSWR12)

| m4 | m5 | m6 | m7 |
|---|---|---|---|
| CS=0.100 | CS=3.600 | CS=10.100 | CS=20.100 |
| MAXVC3=29.753 | MAXVC3=49.765 | MAXVC3=22.959 | MAXVC3=10.159 |

Test-Case Results (700MHz, 34dBm, VSWR12)

| m4 | m5 | m6 | m7 |
|---|---|---|---|
| CS=0.100 | CS=3.600 | CS=10.100 | CS=20.100 |
| MAXVC3=29.576 | MAXVC3=37.200 | MAXVC3=14.290 | MAXVC3=12.286 |

Test-Case Results (700MHz, 34dBm, VSWR12)

| m4 | m5 | m6 | m7 |
|---|---|---|---|
| CS=0.100 | CS=3.600 | CS=10.100 | CS=20.100 |
| MAXVC3=29.511 | MAXVC3=34.948 | MAXVC3=20.734 | MAXVC3=10.846 |

Test-Case Results (700MHz, 34dBm, VSWR12)

| m4 | m5 | m6 | m7 |
|---|---|---|---|
| CS=0.100 | CS=3.600 | CS=10.100 | CS=20.100 |
| MAXVC3=29.435 | MAXVC3=32.249 | MAXVC3=24.445 | MAXVC3=7.166 |

31dBm, 1700 MHz, VSWR12

| m4 | m5 | m6 | m7 |
|---|---|---|---|
| CS=0.100 | CS=3.600 | CS=10.100 | CS=20.100 |
| MAXVC3=22.909 | MAXVC3=8.046 | MAXVC3=2.309 | MAXVC3=1.104 |

31dBm, 1700 MHz, VSWR12

| m4 | m5 | m6 | m7 |
|---|---|---|---|
| CS=0.100 | CS=3.600 | CS=10.100 | CS=20.100 |
| MAXVC3=21.332 | MAXVC3=12.095 | MAXVC3=7.035 | MAXVC3=3.126 |

31dBm, 1700 MHz, VSWR12

| m4 | m5 | m6 | m7 |
|---|---|---|---|
| CS=0.100 | CS=3.600 | CS=10.100 | CS=20.100 |
| MAXVC3=21.332 | MAXVC3=12.095 | MAXVC3=7.035 | MAXVC3=3.126 |

31dBm, 1700 MHz, VSWR12

| m4 | m5 | m6 | m7 |
|---|---|---|---|
| CS=0.100 | CS=3.600 | CS=10.100 | CS=20.100 |
| MAXVC3=21.332 | MAXVC3=12.095 | MAXVC3=7.035 | MAXVC3=3.126 |

ANTENNA TUNING CIRCUIT, METHOD FOR TUNING AN ANTENNA, ANTENNA ARRANGEMENT AND METHOD FOR OPERATING THE SAME

CROSS-REFERENCE TO RELATED APPLICATIONS

This is a continuation application of U.S. application Ser. No. 13/922,080, entitled "Antenna Tuning Circuit, Method for Tuning an Antenna, Antenna Arrangement and Method for Operating the Same" which was filed on Jun. 19, 2013 and is incorporated herein by reference.

TECHNICAL FIELD

The invention relates to an antenna tuning circuit, a method for tuning an antenna, an antenna arrangement and a method for operating an antenna arrangement.

BACKGROUND

General problems for mobile phone antennas are that the antennas are detuned by users touching the phone (strong VSWR (VSWR=Voltage Standing Wave Ratio)).

Further general problems for mobile phone antennas are to address all frequencies while maintaining a high antenna efficiency.

As a result, the input impedance of the antenna is usually not 50 Ohm, and changes quite severely vs. usage.

SUMMARY

An antenna tuning circuit is provided. The antenna tuning circuit comprises an antenna, an inductor and a variable capacitance. The antenna comprises a first terminal, which serves as a feed terminal, and a second terminal, which is separate from the first terminal. The inductor and the variable capacitance are coupled to the second terminal, to tune the antenna.

An antenna tuning circuit is provided. The antenna tuning circuit comprises an antenna, an inductor, a variable capacitance and a tuning switch. The antenna comprises a first terminal, which serves as a feed terminal, and a second terminal, which is separate from the first terminal. The inductor and the variable capacitance are coupled in a series circuit to the second terminal. Thereby, the antenna is tunable in its electrical length by the variable capacitance which is electrically variable with the tuning switch.

A method for tuning an antenna is provided. The antenna comprises a first terminal, which serves as a feed terminal, and a second terminal, which is separate from the first terminal. An inductor and a variable capacitance are coupled to the second terminal. The method comprises varying the capacitance, to thereby tune the antenna.

An antenna arrangement is provided. The antenna arrangement comprises an antenna with a first terminal, which serves as a feed terminal, and a second terminal, which is separate from the first terminal. The antenna arrangement is configured to sense a trimming voltage at the second terminal, and to derive information about a tuning of the antenna from the sensed trimming voltage.

An antenna arrangement is provided. The antenna arrangement comprises an antenna, an inductor and a variable capacitance. The antenna comprises a first terminal, which serves as a feed terminal, and a second terminal, which is separate from the first terminal and arranged such that its position corresponds with a half (or a quarter) of the electrical length of the antenna. The inductor and the variable capacitance are coupled in a series circuit to the second terminal. The antenna arrangement is configured to sense a trimming voltage at the second terminal, to derive an information about a tuning of the antenna from the sensed trimming voltage, and to influence the trimming voltage present at the second terminal by varying (or adjusting) the capacitance or by varying (or adjusting) an inductance of the inductor.

A method for operating an antenna arrangement is provided. The antenna arrangement comprises an antenna with a first terminal, which serves as a feed terminal, and a second terminal, which is separate from the first terminal. The method comprises sensing a voltage at the second terminal, and deriving information about a tuning of the antenna from the sensed voltage.

BRIEF DESCRIPTION OF THE DRAWINGS

Embodiments of the present invention are described herein making reference to the appended drawings.

Figure 1:
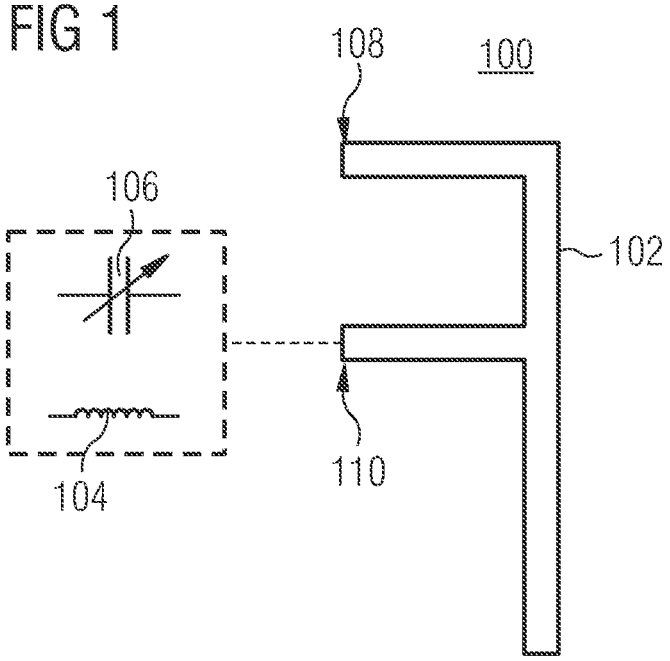
FIG. 1 shows a schematic block diagram of an antenna tuning circuit.

Equal or equivalent elements or elements with equal or equivalent functionality are denoted in the following description by equal or equivalent reference numerals.

DETAILED DESCRIPTION OF ILLUSTRATIVE EMBODIMENTS

In the following description, a plurality of details are set forth to provide a more thorough explanation of embodiments of the present invention. However, it will be apparent to those skilled in art that embodiments of the present invention may be practiced without these specific details. In other instances, well-known structures and devices are shown in block diagram form rather than in detail in order to avoid obscuring embodiments of the present invention. In addition, features of the different embodiments described hereinafter may be combined with each other, unless specifically noted otherwise.

FIG. 1 shows a schematic block diagram of an antenna tuning circuit 100. The antenna tuning circuit 100 comprises an antenna 102, an inductor 104 and a variable capacitance 106.

The antenna 102 comprises a first terminal 108, which serves as a feed terminal, and a second terminal no, which is separate from the first terminal 108. The inductor 104 and the variable capacitor 106 are coupled to the second terminal no to tune the antenna 102.

As shown in FIG. 1, the antenna 102 can be a PIF antenna (PIF=Planar Inverted F-Shaped) comprising the first terminal 108 and the second terminal no. The first terminal 108 can be used as a feed terminal. The second terminal 100 can be used for adjusting an electrical length of the antenna 102. Thereby, the second terminal 100 can be separate from the first terminal 108 and arranged such that its position corresponds with a half (or a quarter) of the electric length of the antenna 102.

As already mentioned, the antenna tuning circuit 100 comprises an inductor 104 and a variable capacitor 106 that are coupled to the second terminal no of the antenna 102 in order to tune the antenna 102, or in other words, to adjust the electrical length of the antenna 102.

Thereby, the antenna 102 can be tunable in its electrical length by the variable capacitor 106. Further, the inductor 104 can be a variable inductor, wherein the antenna 102 can be tunable in its electrical length by the variable inductor 104. Naturally, it is also possible that the antenna 102 is tunable in its electrical length by both the variable capacitor 106 and the variable inductor 104.

Figure 2:
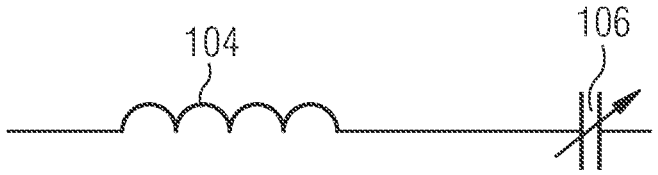
FIG. 2 shows a schematic circuit diagram of the inductor and the variable capacitance.

FIG. 2 shows a schematic circuit diagram of the inductor 104 and the variable capacitor 106.

As indicated in FIG. 2, the variable or adjustable capacitor 106 may provide a variable capacitor.

The inductor 104 and the variable capacitor 106 can be connected in series, or in other words, form a series circuit.

The series circuit comprising the inductor 104 and the variable capacitor 106 can be connected to the second terminal no of the antenna 102, for example, such that the variable resistance 106 is connected directly to the second terminal no of the antenna 102.

Further, the inductor 104 and the variable capacitor 106 can be connected in series between the second terminal no of the antenna 102 and a reference terminal configured to provide a reference potential, such as a ground terminal providing a ground potential.

Note that the antenna tuning circuit 100 may comprise a plurality of inductors that can be connected via a SP×T switch (SP×T=Single Pole×Throw) to the variable capacitor 106. The plurality of inductors may comprise different inductance values, wherein one inductor of the plurality of inductors can be connected via the SP×T switch to the variable capacitance 106 in dependence on a selected antenna band. Thereby, the variable capacitance 106 can be used to fine tune the selected inductor of the plurality of inductors.

Thus, in contrast to common solutions, which use a plurality of inductors that are connected directly via a SP×T switch (SP×T=Single Pole×Throw) to the second terminal no of the antenna 102, the antenna tuning circuit 100 comprises a capacitive component (or capacitor) 106 to at least fine tune the selected inductor. In other words, in embodiments a capacitive component (or capacitor) 106 is added to at least fine tune the selected inductor. For loss reasons, SMD high-Q inductors may be used (SMD=Surface Mounted Device). Using a large series capacitor, the inductance can be reduced in small steps as indicated in FIG. 2.

Figure 3:
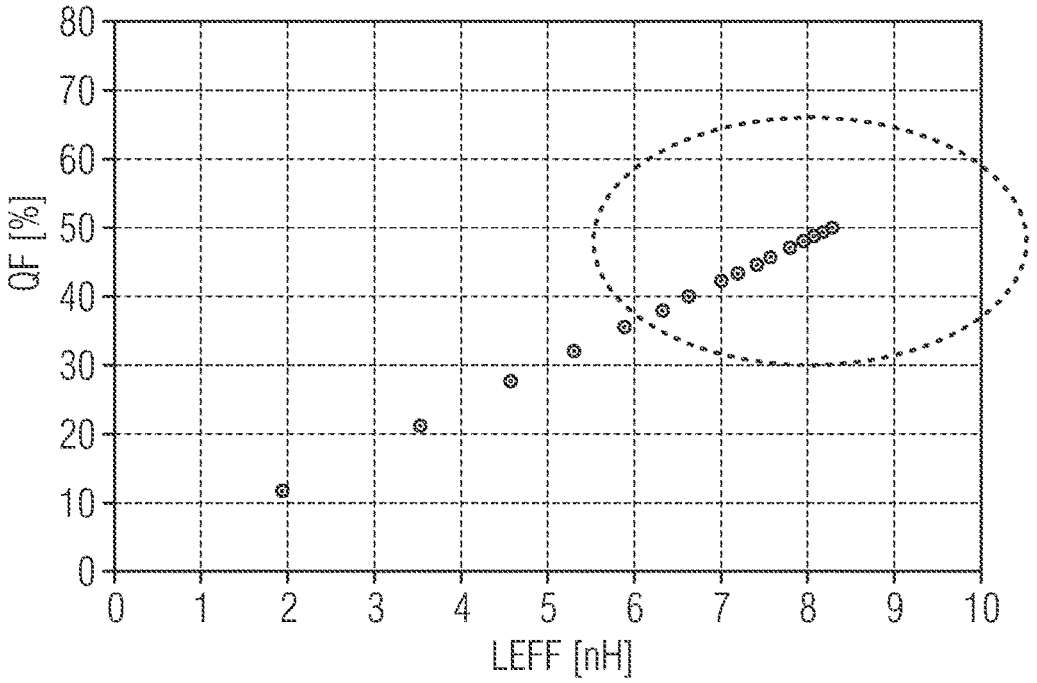
FIG. 3 shows in a diagram the Q-factor of a series circuit comprising an exemplary inductor having an inductance of 15 nH and an ideal variable capacitor plotted over the effective inductance of the series circuit.

The disadvantage is that this method may reduce the Q-factor (or quality factor), as will become clear from the discussion of FIG. 3.

FIG. 3 shows in a diagram the Q-factor QF of an exemplary 15 nH inductor 104 and an ideal variable capacitor 106 plotted over the effective inductance $L_{EFF}$ of the series circuit comprising the inductor 104 and the variable capacitor 106. Thereby, the ordinate denotes the Q-factor QF in percent (%), wherein the abscissa denotes the effective inductance $L_{EFF}$ in nH.

In other words, FIG. 3 shows a drastic method, by sweeping the variable capacitance down to very low values. Here a 15 nH inductor and an ideal capacitor were used (Murata LQW inductor). It can be seen that as long as the inductance is not detuned too much (e.g., 10 to 20% of nominal value), the Q-factor reduction is limited to acceptable values.

The main advantage is that the inductance can be tuned to the really wanted value, and in addition, the amount of available tuning steps is higher. A measurement of the phone in the antenna chamber can be thought of and the antenna can be fine-tuned to maximum radiation. As well, the baseband could automatically fine-tune the antenna frequency-wise and not only band-wise.

In various embodiments, the antenna tuning circuit comprises a circuit wherein an electrical reactance of the variable capacitance is less than 50% of an electrical reactance of the selected inductor.

The detection of the feed-point voltage in addition can be used to retune the antenna to its environment. Usually, touching the antenna means adding a capacitance to it. This can be overcome by adding more inductance than initially needed. Therefore, a designer can add larger inductance to tune out the hand touch influence. If the feed point is a ground, then the VSWR indication is easy. The more voltage, the more mismatch, and hence the more inductance is needed.

Figure 4:
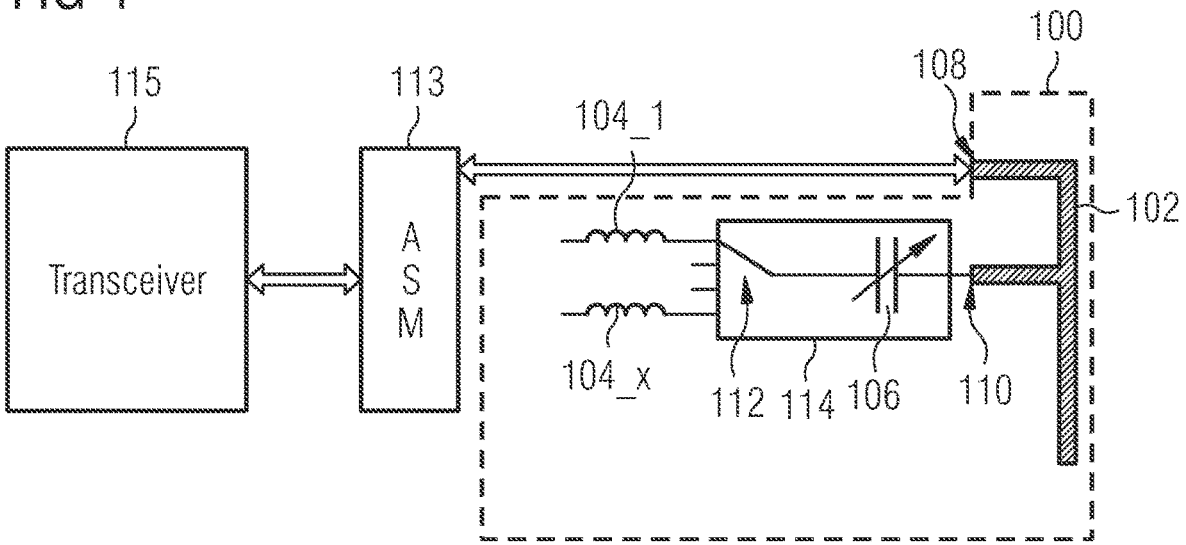
FIG. 4 shows a schematic block diagram of the antenna tuning circuit.

FIG. 4 shows a schematic block diagram of the antenna tuning circuit 100. The antenna tuning circuit 100 comprises the antenna 102, the variable capacitor 106 and a plurality of inductors 104_1 to **104_*x*, wherein x is a natural number greater than or equal to one, x≥1. Thereby, each inductor of the plurality of inductors 104_1 to 104_*x*** may comprise a different inductance.

The antenna tuning circuit 100 may be configured to connect one inductor of the plurality of inductors 104_1 to **104_*x* to the variable capacitor 106, wherein the antenna tuning circuit 100 may be configured to select the one capacitor of the plurality of capacitors 104_1 to 104_*x*, for example, based on an active antenna band. Further, the antenna tuning circuit can be configured to fine-tune the antenna 102, or in other words, the electrical length of the antenna 102 by means of the variable capacitor 106**.

For example, as shown in FIG. 4, the antenna tuning circuit 100 may comprise a SP×T switch 112 connected in series between the plurality of inductors 104_1 to **104_*x* and the variable capacitance 106, wherein the antenna tuning circuit 100 can be configured to connect one inductor of the plurality of inductors 104_1 to 104_*x* to the variable capacitor 106 via (or by means of) the SP×T switch 112**.

As indicated in FIG. 4, the antenna tuning circuit 100 may comprise a tuning switch 114 that comprises the variable capacitor 106 and the SP×T switch.

Thereby, the variable capacitor 106 may comprise at least one variable capacitor which is electrically variable (or adjustable) with the tuning switch 114.

Further, also the inductor 104 can be electrically variable (or adjustable) with the tuning switch 114. As already mentioned, a variable inductor may be implemented, for example, by a plurality of inductors 104_1 to **104_*x* having different inductance values and a SP×T switch 112 configured to connect one inductor of the plurality of inductors 104_1 to 104_*x* to the variable (or adjustable) capacitor 106**.

As already indicated, the first terminal 108 of the antenna 102 serves as a feed terminal. For example, as exemplarily shown in FIG. 4, the first terminal 108 of the antenna 102 may be connected to an antenna switch module (ASM) 113, wherein the antenna switch module 113 may be connected to a transceiver 115.

As shown in FIG. 4, the core idea is to add a tunable capacitor 106 that can easily be realized, for example, by a NMOS transistor chain (NMOS=n-Type Metal-Oxide-Semiconductor), inside of the tuning switch 114 to further add tuning possibility. Combined with an RFFE-digital bus (RFFE=Radio Frequency Front End) the phone can be optimized by software just testing the optimum bit combination (compare with FIG. 5).

Figure 5:
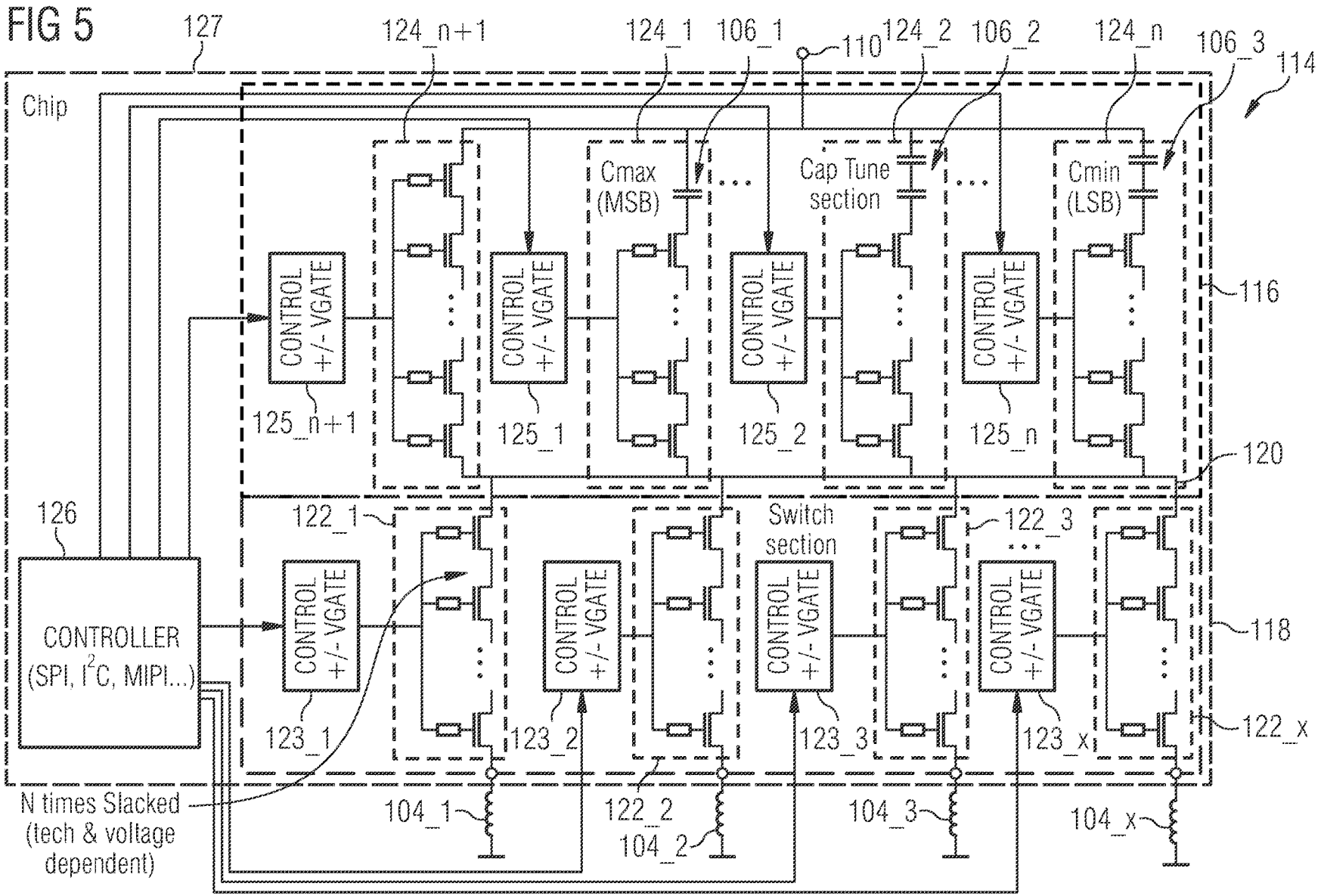
FIG. 5 shows a schematic block diagram of the antenna tuning circuit.

FIG. 5 shows a schematic block diagram of the antenna tuning circuit 100. The antenna tuning circuit 100 comprises the antenna 102 (not shown in FIG. 5, see FIGS. 1 and 4), the tuning switch 114 and the plurality of inductors 104_1 to **104_*x***.

The tuning switch 114 can be sub-divided into a capacitor tune section 116 and a switch section 118. The capacitor tune section 116 and the switch section 118 can be connected to each other via a common network node 120.

The switch section 118 may implement the SP×T switch 112 via a plurality of transistor chains 122_1 to **122_*x*, wherein the plurality of transistor chains 122_1 to 122_*x* are configured to connect the plurality of inductors 104_1 to 104_*x* to the common network node 120**.

For example, a first transistor chain 122_1 of the plurality of transistor chains 122_1 to **122_*x* can be connected in series between the first inductor 104_1 and the common network node 120 in order to connect the first inductor 104_1 in dependence on the active antenna band to the common network node 120. A second transistor chain 122_2 of the plurality of transistor chains 122_1 to 122_*x* can be connected in series between the second inductor 104_2 and the common network node 120 in order to connect the second inductor 104_2 in dependence on the active antenna band to the common network node 120. Similarly, an x-th transistor chain 122_*x* of the plurality of transistor chains 122_1 to 122_*x* can be connected in series between the x-th inductor 104_1 and the common network node 120 in order to connect the x-th inductor 104_1 in dependence on the active antenna band to the common network node 120**.

Note that each transistor chain of the plurality of transistor chains 122_1 to **122_*x* of the switch section 118 may comprise at least two transistors, wherein channels of the at least two transistors are connected in series between the common network node 120 and the respective inductor of the plurality of inductors 104_1 to 104_*x***.

Further, the switch section 118 can comprise a plurality of transistor chain control units 123_1 to **123_*x* configured to provide control voltages (e.g., positive and negative gate voltages) for controlling the transistors of the plurality of transistor chains 122_1 to 122_*x* of the switch section 118**.

For example, a first transistor chain control unit 123_1 may be configured to provide a first control voltage for controlling the transistors of the first transistor chain 122_1, wherein a second transistor chain control unit 123_2 may be configured to provide a second control voltage for the transistors of the second transistor chain 122_1, and wherein an x-th transistor chain control unit **123_*x* may be configured to provide a x-th control voltage for the transistors of the x-th transistor chain 122_*x***.

Thereby, each transistor chain control unit of the plurality of transistor chain control units 123_1 to **123_*x* of the switch section 118** can be connected to the transistors of the respective transistor chain via (gate) resistors.

The capacitor tune section 116 may implement the variable capacitor 106 by means of a plurality of capacitors 106_1 to **106_*n* and a plurality of transistor chains 124_1 to 124_*n*, wherein n is a natural number greater than or equal to one, n≥1. Thereby, the plurality of capacitors 106_1 and 106_*n* and the plurality of transistor chains 124_1 to 124_*n* of the capacitor tune section 116 can be connected in series between the second terminal no of the antenna 102 (see FIGS. 1 and 4) and the common network node 120**.

Note that a capacitor of the plurality of capacitors 106_1 to **106_*n*** may be implemented by at least two serially connected capacitors.

For example, a first capacitor 106_1 of the plurality of capacitors 106_1 to **106_*n* and a first transistor chain 124_1 of the plurality of transistor chains 124_1 to 124_*n* can be connected in series between the second terminal no of the antenna 102 and the common network node 120. A second capacitor 106_2 of the plurality of capacitors 106_1 to 106_*n* and a second transistor chain 124_2 of the plurality of transistor chains 124_1 to 124_*n* can be connected in series between the second terminal no of the antenna 102 and the common network node 120**. Similarly, an n-th capacitor 106_n of the plurality of capacitors 106_1 to 106_n and an n-th transistor chain 124_n of the plurality of transistor chains 124_1 to 124_n can be connected in series between the second terminal no of the antenna 102 and the common network node 120.

Observe that each transistor chain of the plurality of transistor chains 124_1 to 124_n of the capacitor tune section 116 may comprise at least two transistors, wherein channels of the at least two transistors are connected in series between the common network node 120 and the respective capacitor of the plurality of capacitors 106_1 to 106_n.

Further, the capacitor tune section 116 can comprise a plurality of transistor chain control units 125_1 to 125_n configured to provide control voltages (e.g., positive and negative gate voltages) for controlling the transistors of the plurality of transistor chains 124_1 to 124_n of the capacitor tune section 116.

For example, a first transistor chain control unit 125_1 may be configured to provide a first control voltage for controlling the transistors of the first transistor chain 124_1, wherein a second transistor chain control unit 125_2 may be configured to provide a second control voltage for the transistors of the second transistor chain 124_2, and wherein an n-th transistor chain control unit 125_n may be configured to provide an n-th control voltage for the transistors of the n-th transistor chain 124_n.

Thereby, each transistor chain control unit of the plurality of transistor chain control units 125_1 to 125_n of the capacitor tune section 116 can be connected to the transistors of the respective transistor chain via (gate) resistors.

Observe that the capacitor tune section 116 may comprise a further transistor chain 124_n+1 connected in series between second terminal 110 of the antenna 102 and the common network node 120. In addition, the capacitor tune section 116 may comprise a further transistor chain control unit 125_n+1 configured to provide a control voltage for controlling the transistors of the further transistor chain 124_n+1.

The antenna tuning circuit 100 can comprise an interface controller 126, such as a SPI (SPI=Serial Peripheral Interface), I2C (I2C=Inter-Integrated Circuit) or MIPI (MIPI=Mobile Industry Processor Interface).

The interface controller 126 can be configured to control the transistor chain control units 125_1 to 125_n (and the further transistor chain control unit 125_n+1) of the capacitor tune section 116 and the transistor chain control units 123_1 to 123_x of the switch section 118.

For example, the interface controller 126 can be configured to control the transistor chain control units 125_1 to 125_n of the capacitor tune section 116 based on control information comprising n bits.

Thereby, each transistor chain control unit of the plurality of transistor chain control units 125_1 to 125_n can be controlled based on one bit of the n bits of the control information, e.g., the first transistor chain control unit 125_1 may be controlled based on the most significant bit (MSB) of the control information, wherein the n-th transistor chain control unit 125_1 may be controlled by the least significant bit (LSB) of the control information.

Observe that the tuning switch 114 including the capacitor tune section 116 and the switch section 118, and the interface controller 126 may be implemented on a common chip 127.

In the following, an antenna arrangement is described. Thereby, the above description of the antenna tuning circuit 100 does also apply to the antenna arrangement.

Figure 6:
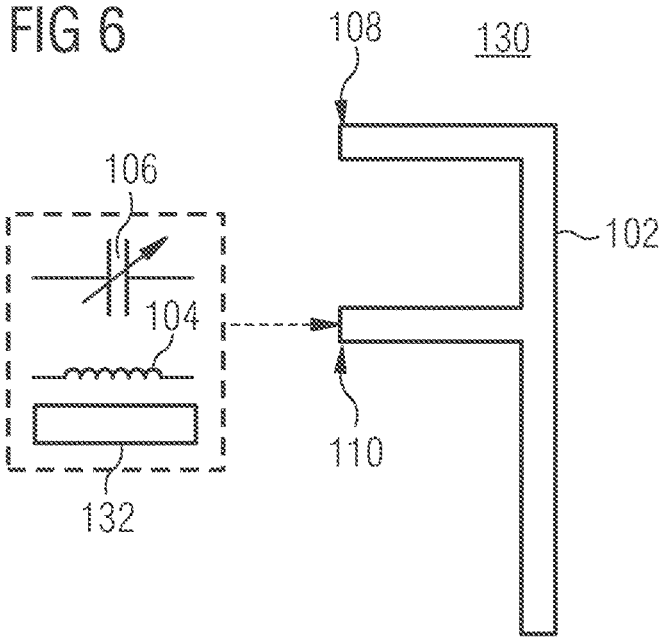
FIG. 6 shows a schematic block diagram of an antenna arrangement.

FIG. 6 shows a schematic block diagram of an antenna arrangement 130. The antenna arrangement 130 comprises an antenna 102 with a first terminal 108, which serves as a feed terminal, and a second terminal no, which is separate from first terminal. The antenna arrangement 130 is configured to sense a trimming voltage at the second terminal no of the antenna 102, and to derive an information about a tuning of the antenna 102 from the sensed trimming voltage.

As already mentioned above, the antenna 102 can be a PIF antenna. Thereby, the second terminal no can be arranged such that its position corresponds with a half (or a quarter) of the electrical length of the antenna 102.

The antenna arrangement 130 can comprise a unit 132 that is configured to sense the trimming voltage at the second terminal 110 of the antenna 102, and to derive the information about the tuning of the antenna 102 from the sensed trimming voltage.

Further, the antenna arrangement 130 can comprise an inductor 104 and a variable capacitor 106 coupled to the second terminal 110 of the antenna 102. Thereby, the antenna arrangement 130 can be configured to influence the trimming voltage at the second terminal 110 of the antenna 102 by varying the variable capacitance 106.

Moreover, the inductor 104 can be a variable inductor, wherein the antenna arrangement 130 can be configured to influence the trimming voltage at the second terminal 110 by varying an inductance of the variable inductor.

Figure 7:
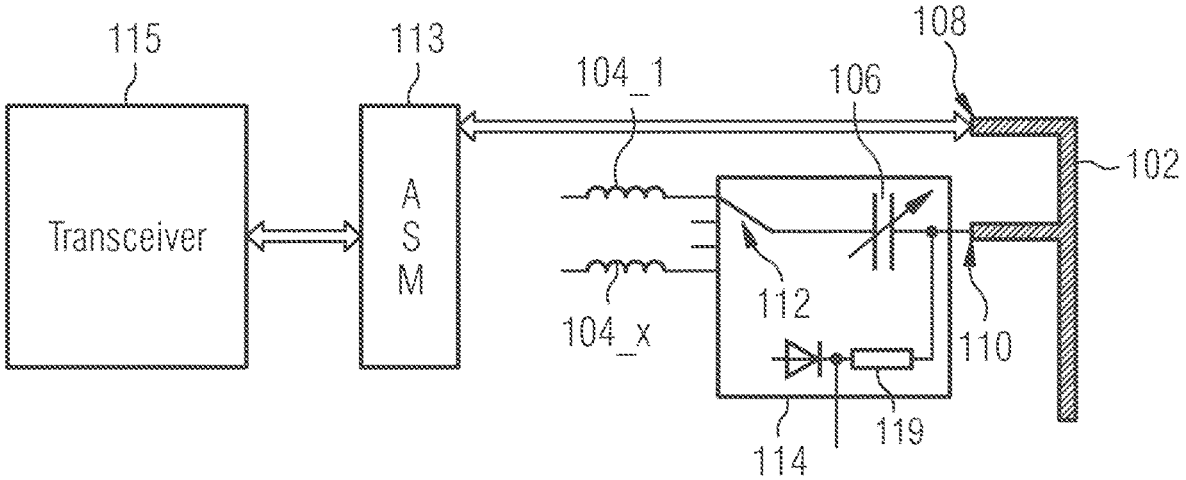
FIG. 7 shows a schematic block diagram of the antenna arrangement.

FIG. 7 shows a schematic block diagram of the antenna arrangement 130. In contrast to the antenna tuning circuit 100 shown in FIG. 4, the antenna arrangement 130 shown in FIG. 7 further comprises a resistor 119 connected to the second terminal 110 of the antenna 102, wherein the trimming voltage can be sensed at the resistor 119.

Thereby, the resistor 119 may comprise a resistance value that is at least ten times higher than an impedance of the antenna 102.

For example, the resistor 116 may comprise a resistance value of 500 Ohm or 5 kOhm (or within a range between 250 and 750 Ohm, between 250 Ohm and 7.5 kOhm, or between 2.5 kOhm and 7.5 kOhm).

Note that the resistor 119 may be implemented within the tuning switch 114.

As already described in detail above, the tuning switch 114 comprises the variable resistance 106 and the SP×T switch 112, wherein the tuning switch is configured to connect via the SP×T switch 112 one inductor of the plurality of inductors 104_1 to 104_x that comprise different inductance values to the variable resistance 106.

Thus, the tuning switch 114 can be configured to vary a capacitance of a variable capacitor 106 or to vary an inductance of the inductor (which may be implemented by the plurality of inductors 104_1 to 104_x and the SP×T switch 112), in order to influence the trimming voltage present at the second terminal 110 of the antenna 102.

For example, the antenna arrangement 130 can be configured to reduce the trimming voltage (e.g., below 1 Veff) present at the second terminal 110, e.g., via the tuning switch 114, by varying at least one of the variable capacitance and the inductance (which may be implemented by the plurality of inductors 104_1 to 104_x and the SP×T switch 112) using a successive approximation.

In other words, (as already mentioned in part with respect to the antenna tuning circuit 100), in embodiments a tunable capacitor is added, that can easy be realized, for example, by a NMOS transistor chain, inside of the tuning switch 114 to further add tuning possibility. Combined with, for example, an RFFE-digital bus the phone can be optimized by software just testing the optimum bit combination.

Another point here is the fact, that on this position the mismatch of the antenna 102 can be sensed. If the design is well known, the correct voltage can be calculated. If the voltage is higher that this value, the antenna 102 is detuned (see the block circuit shown in FIG. 7).

Additionally, the ASM 113 feed-point can be sensed as well, as also there the difference to the nominal voltage indicates the antenna 102 mismatch.

The detector can be, for example, a classic voltage detector at the connection point (top ring). As a diode, the NMOS transistor or a similar device can be used.

Note that the switch also can be implemented using PIN diodes or GaAs pHEMT (pHEMT=p-Type High-Electron-Mobility Transistor). The capacitor bank can also be realized in a series capacitor configuration instead of a parallel. But as here high capacitances are wanted, the parallel approach ends in a much smaller size.

In the following, tuning of the inductor 104 (e.g., via the variable capacitor 106) is described in further detail.

The L-C combination (inductor 104 and variable capacitor 106 combination) may have two major problems.

On the one hand, the inductance value (L value) can be at maximum halved, otherwise the Q-factor drops to strong (e.g., below Q=10).

On the other hand, a combination (of the inductor 104 and the variable capacitor 106) can run into self-resonance. This has two negative impacts. First, the voltage stress dramatically increases, which requires a much higher stacking, which in turn results in a loss of Q-factor. Second, this high voltage may negatively impact IMD (IMD=Intermodulation Distortion) and harmonics.

Therefore, as a rule of thumb, a higher minimum capacitance value ($C_{min}$ of higher value) is beneficial to avoid the possibility of self-resonance and high RF (RF=Radio Frequency) voltage swing.

For example, a combination of an inductor 104 having an inductance value L of 8.2 nH, and a variable capacitance 106 having a minimum capacitance value $C_{min}$ of 10 pF results in an effective inductance of 4 nH which leads to a Q-factor of Q=15 (700 MHz).

Further, a combination of an inductor 104 having an inductance value L of 8.2 nH, and a variable capacitor 106 having a minimum capacitance value $C_{min}$ of 7.5 pF results in an effective inductance of 2.8 nH which leads to a Q-factor of Q=8 (700 MHz), which is not more of interest.

Further, a combination of an inductor 104 having an inductance value L of 8.2 nH, and a variable capacitor 106 having a minimum capacitance value $C_{min}$ of 2.5 pF is capacitive and up to 90 V RF (34 dBmVSWR12).

Figure 8:
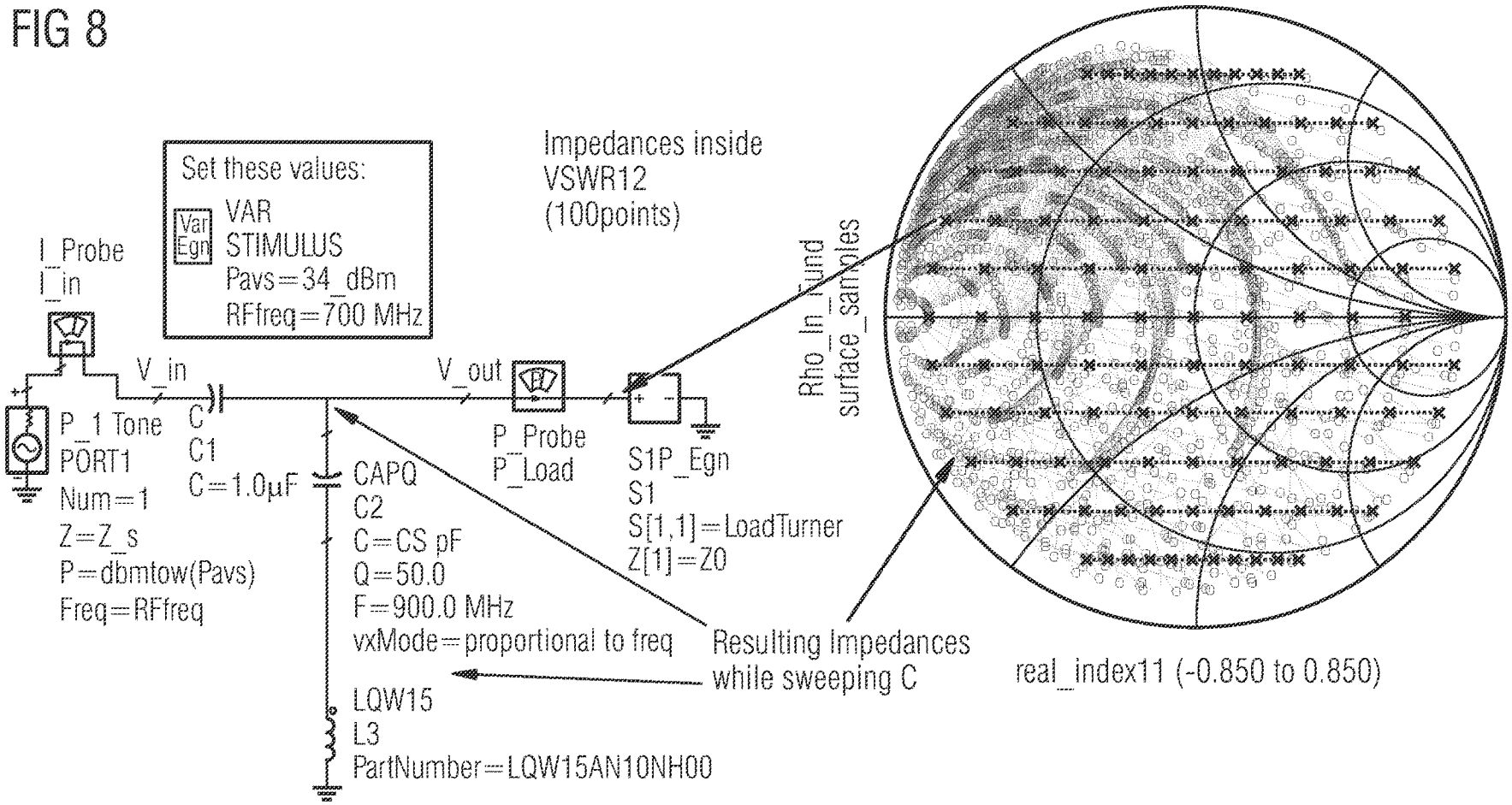
FIG. 8 shows a schematic circuit diagram of a tunable capacitance to tune the inductance and a smith-chart with the sketch of interaction between arbitrary 100 impedance points of inside an VSWR 12 circle load and the resulting input impedance when applying the LC-circuit over all operation modes.

FIG. 8 shows a schematic circuit diagram of the tunable capacitor and one inductor and a smith-chart of arbitrary impedance inside a VSWR 12 circle that represent all possible loads to the LC circuit and as a second plot the resulting load to the port due to the matching function.

Figure 9:
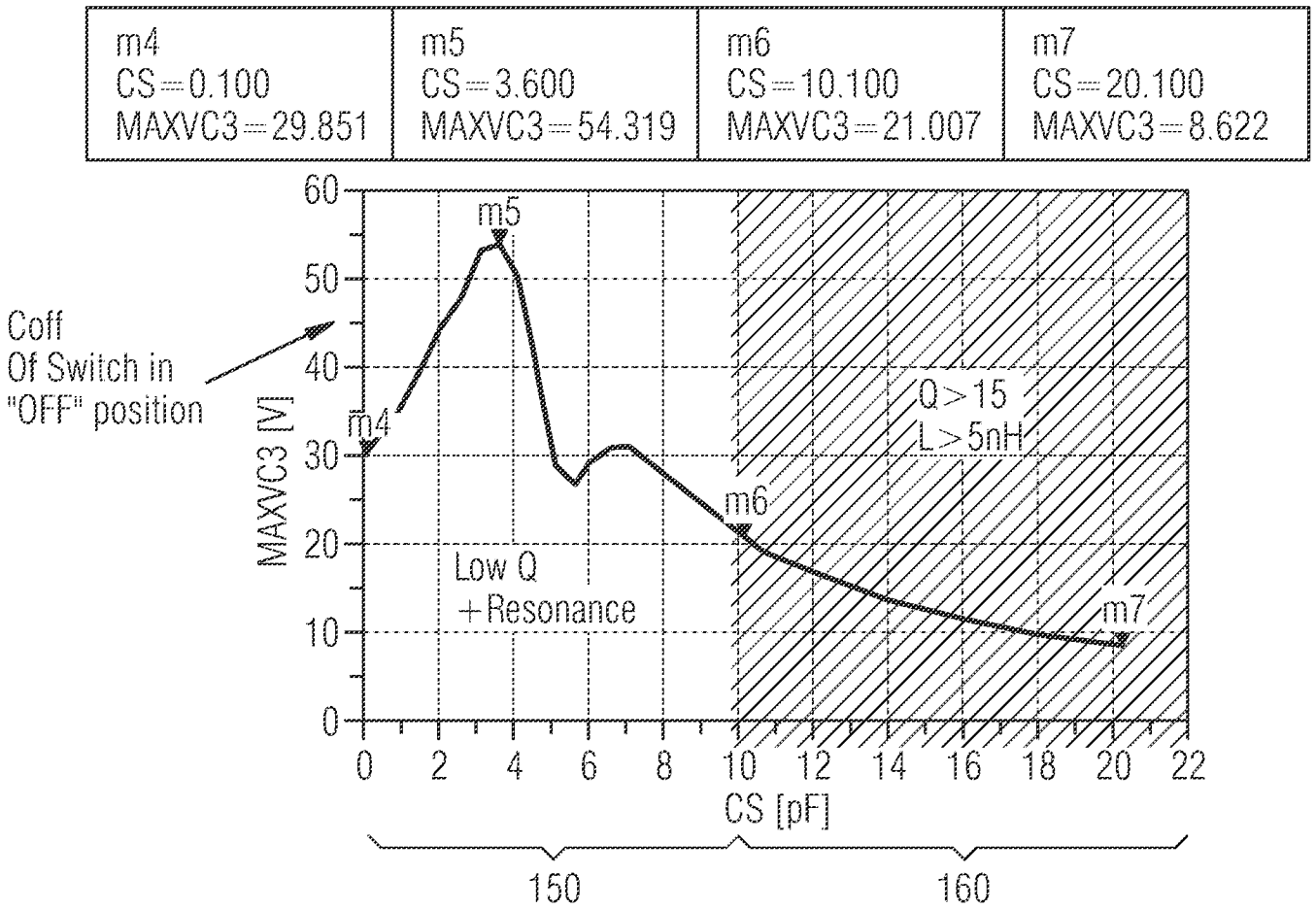
FIG. 9 shows in a diagram simulation results of the maximum voltage over the tunable capacitor plotted over the capacitance of the third capacitor in the configuration of FIG. 2 for an RF power level of 34 dBm.
Figure 10A:
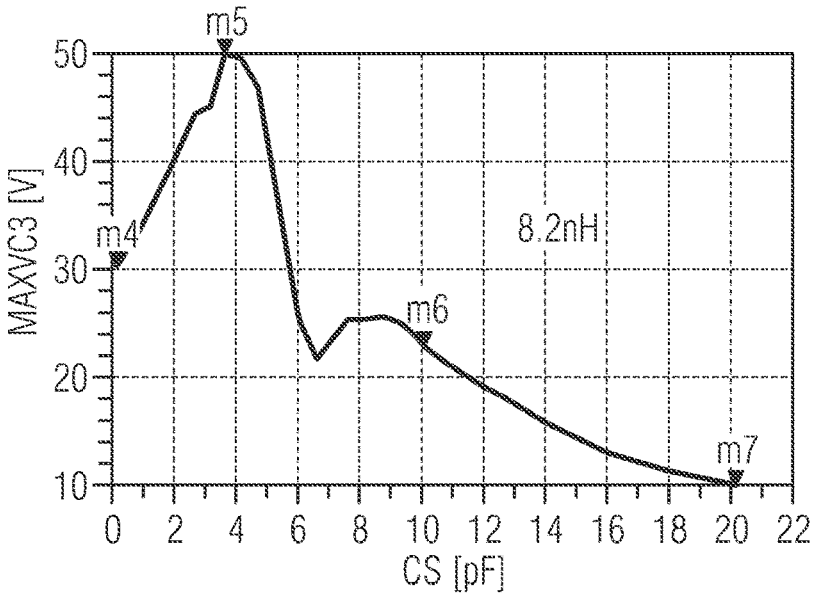
FIGS. 10A to 10D show in diagrams simulation results of the maximum voltage over the tunable capacitor plotted over the capacitance of the third capacitor for four different inductance values of the inductor in the configuration of FIG. 2.
Figure 10B:
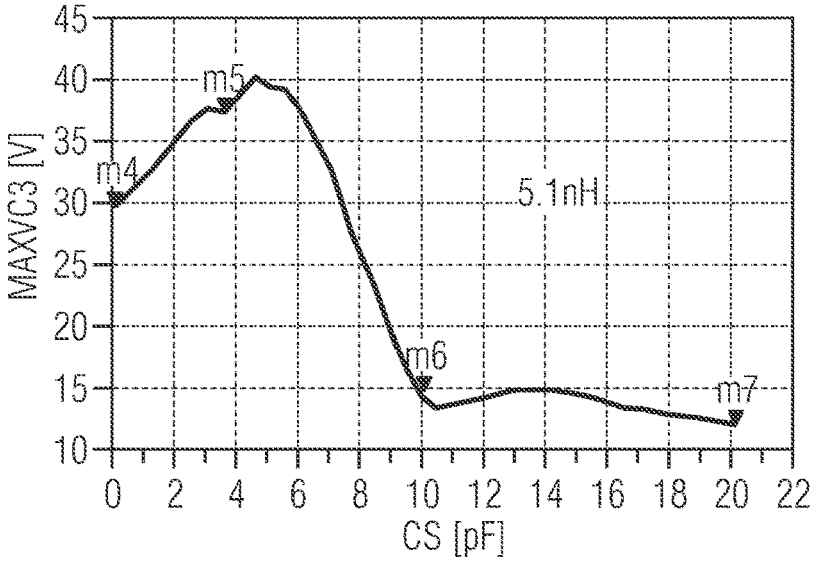
Figure 10C:
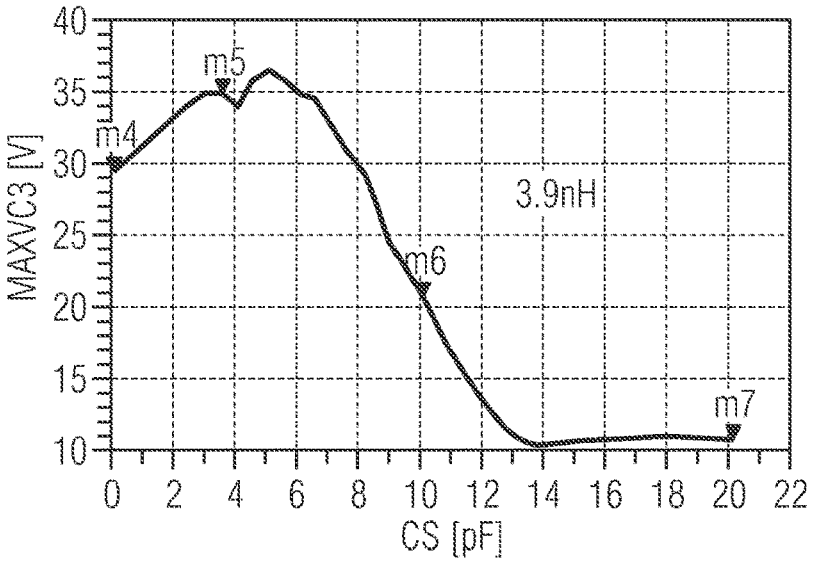
Figure 10D:
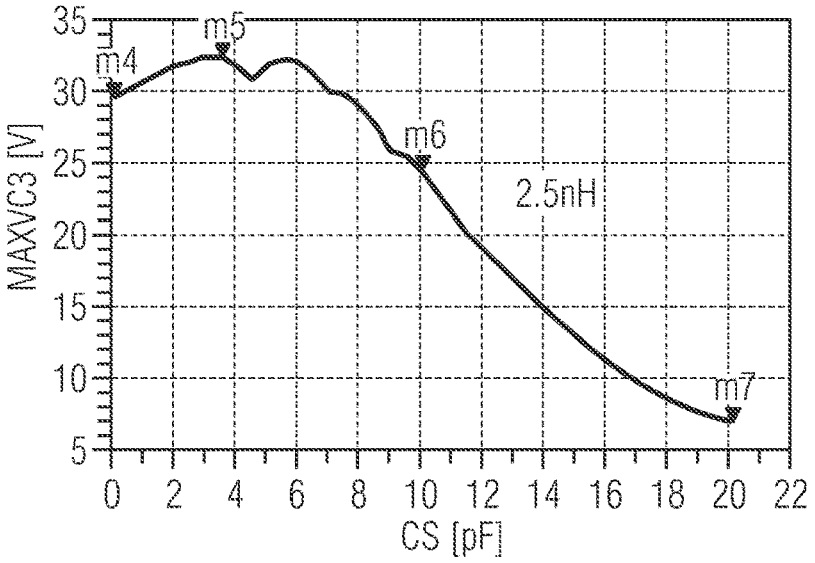
Figure 11A:
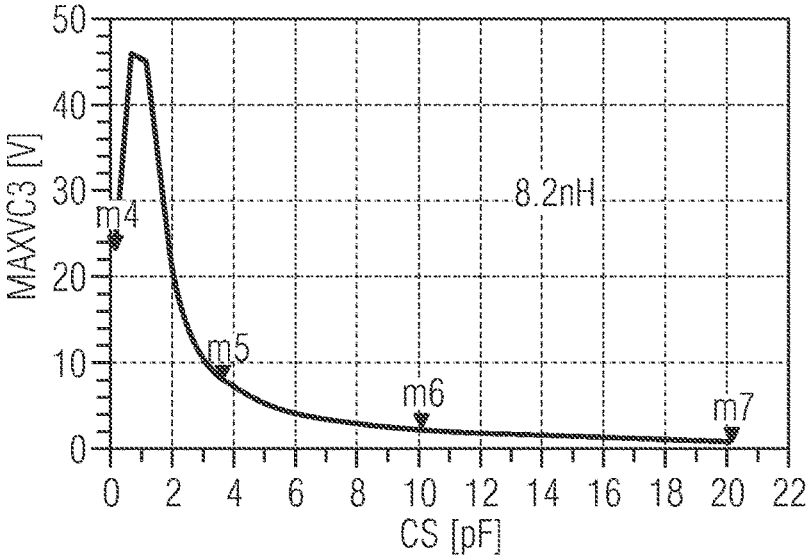
FIGS. 11A to 11D show in diagrams simulation results of the maximum voltage over the tunable capacitor plotted over the capacitance of the third capacitor for four different inductance values of the inductor for a higher operating frequency.
Figure 11B:
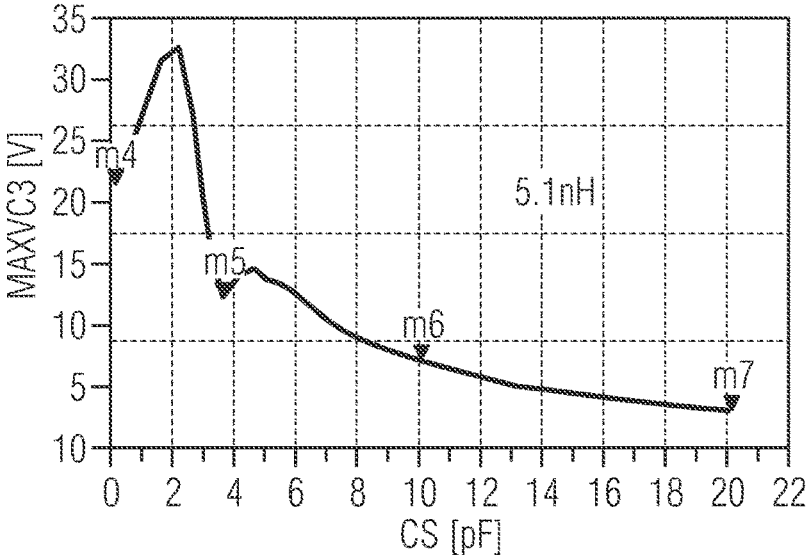
Figure 11C:
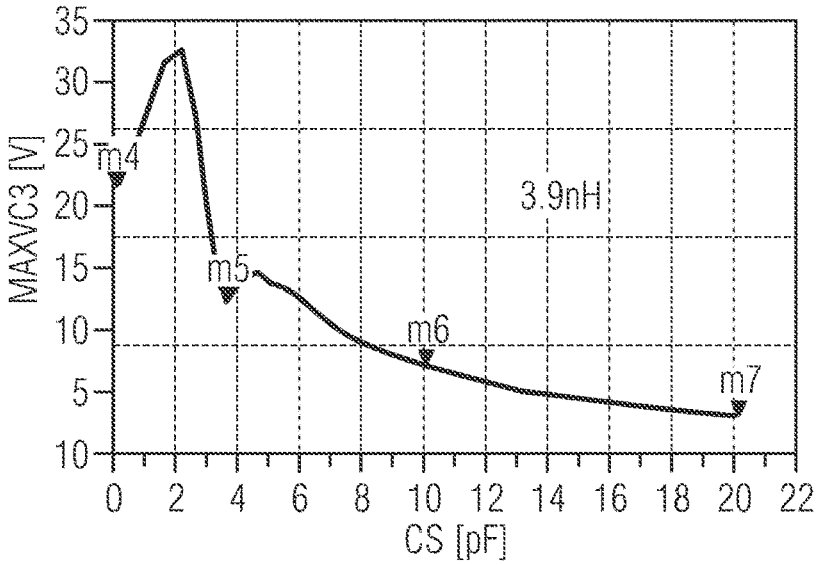
Figure 11D:
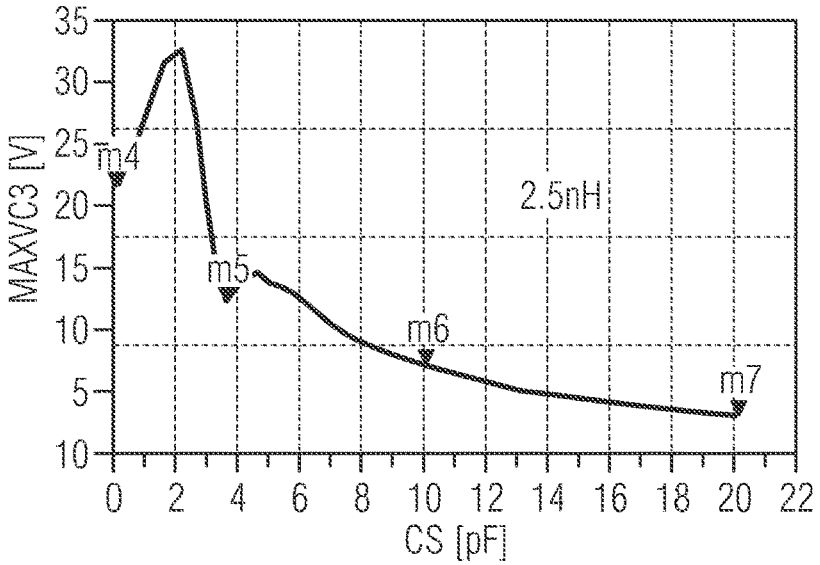
Figure 12A:
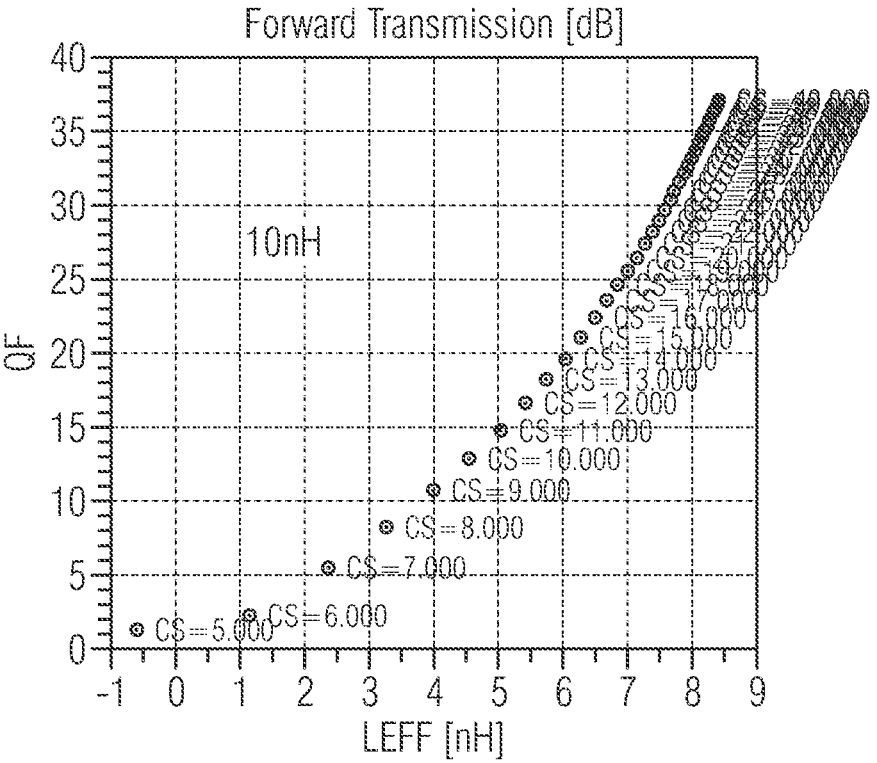
FIGS. 12A to 12D show in diagrams simulation results of the Q-factor plotted over the effective inductance of the series circuit comprising the inductor and the variable capacitance for four different inductance values of the inductor and at 700 MHz.
Figure 12B:
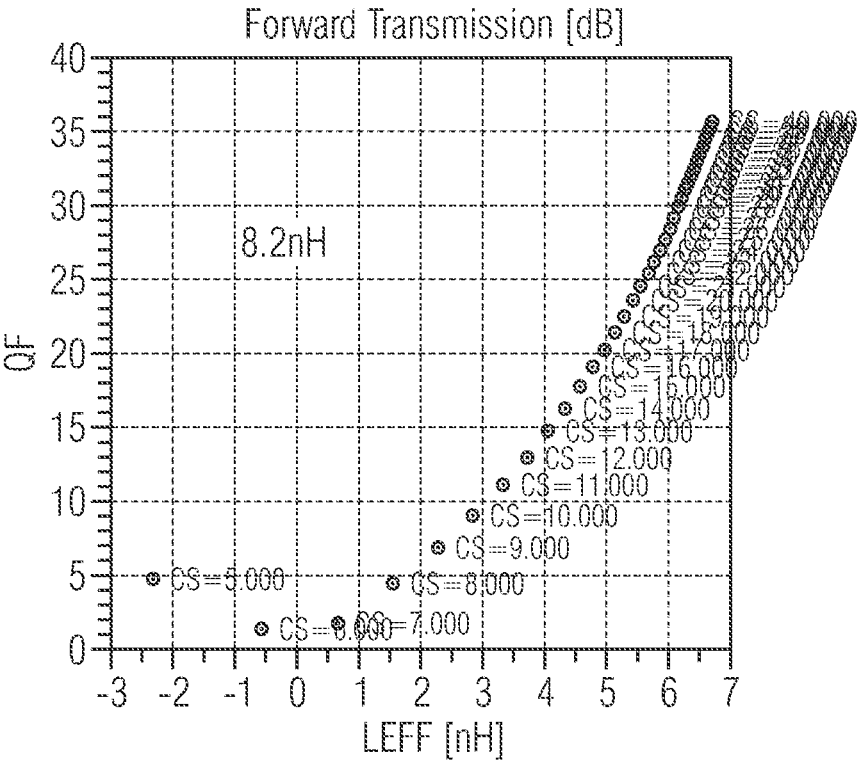
Figure 12C:
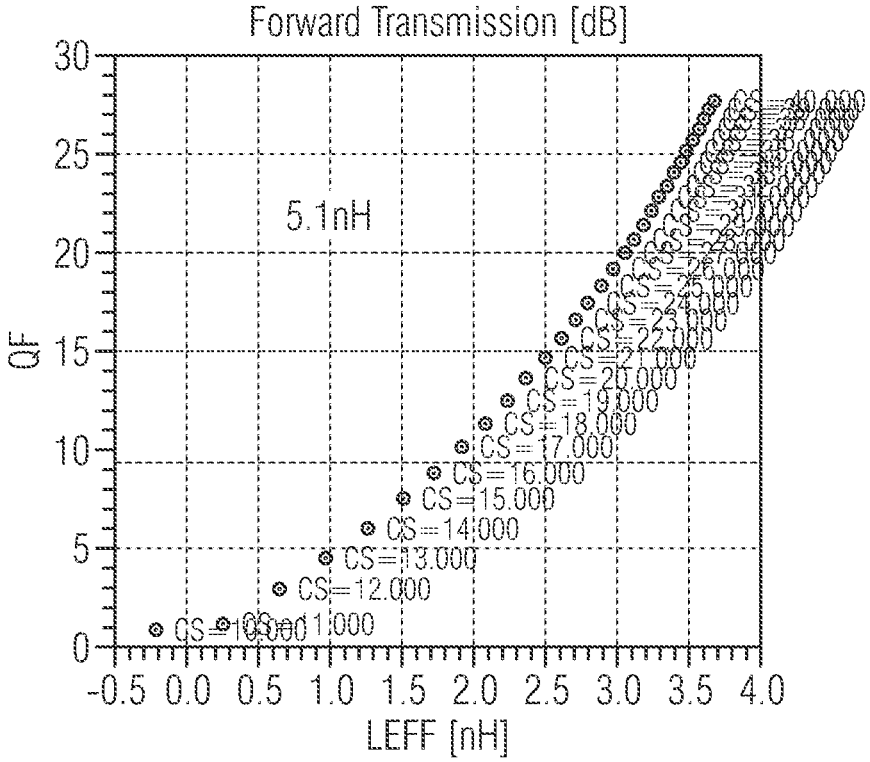
Figure 12D:
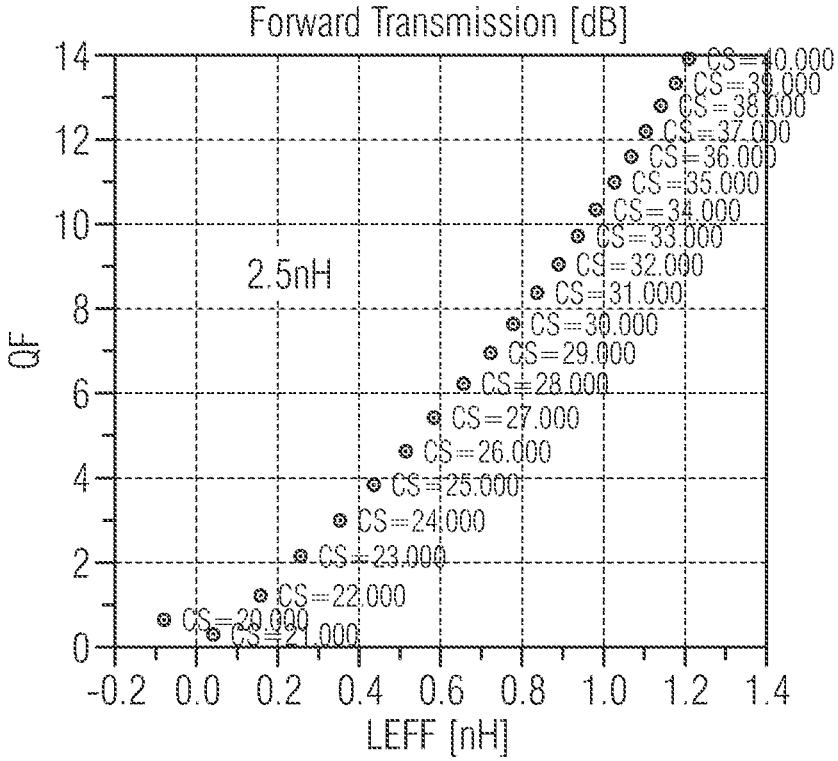
Figure 13A:
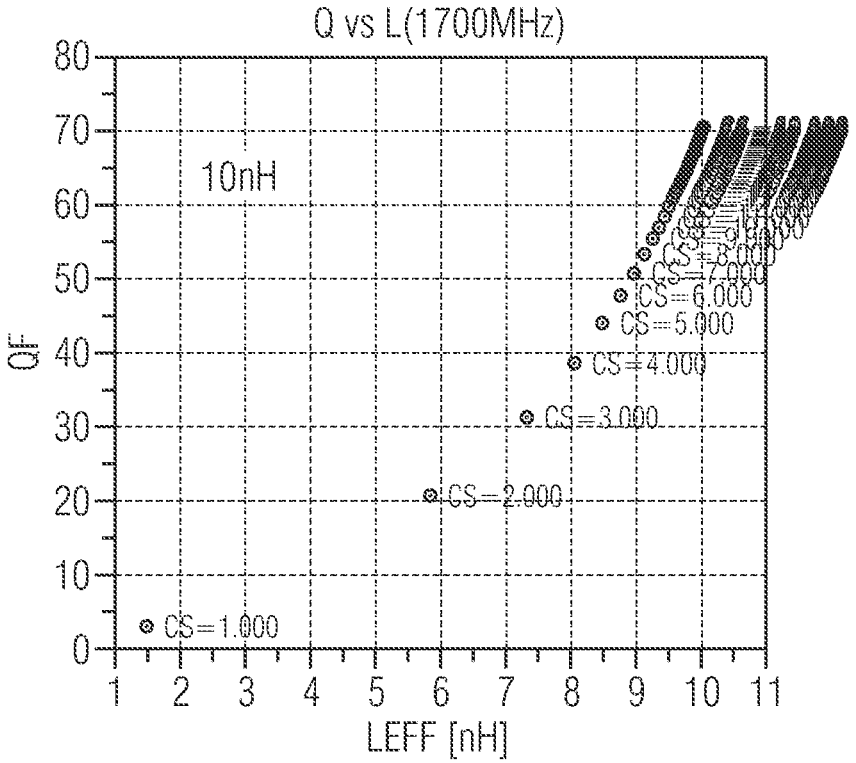
FIGS. 13A to 13D show in diagrams simulation results of the Q-factor plotted over the effective inductance of the series circuit comprising the inductor and the variable capacitance for four different inductance values of the inductor and at 1,700 MHz.
Figure 13B:
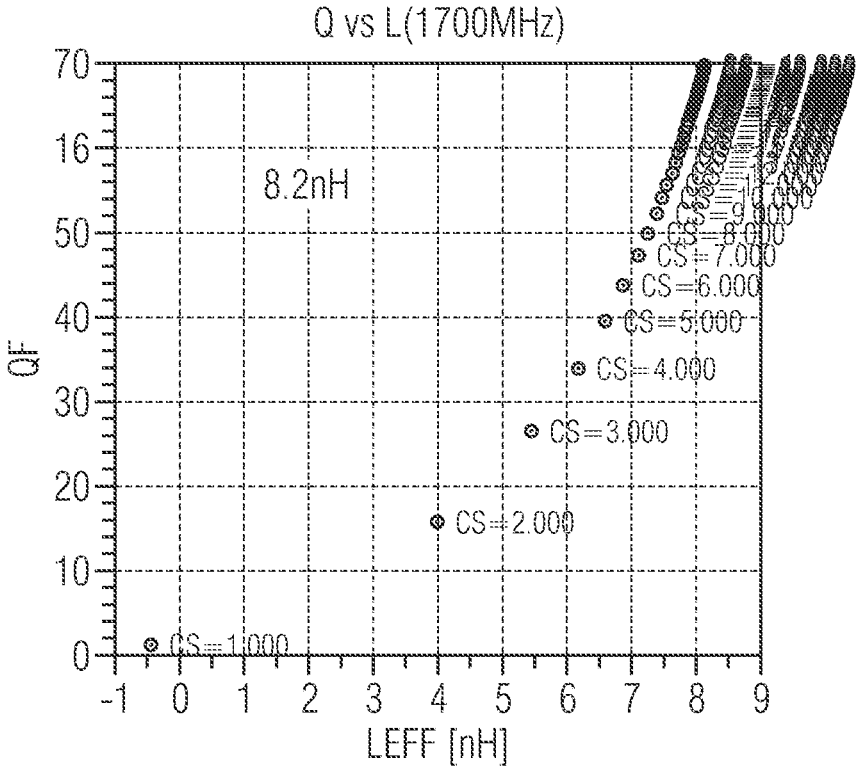
Figure 13C:
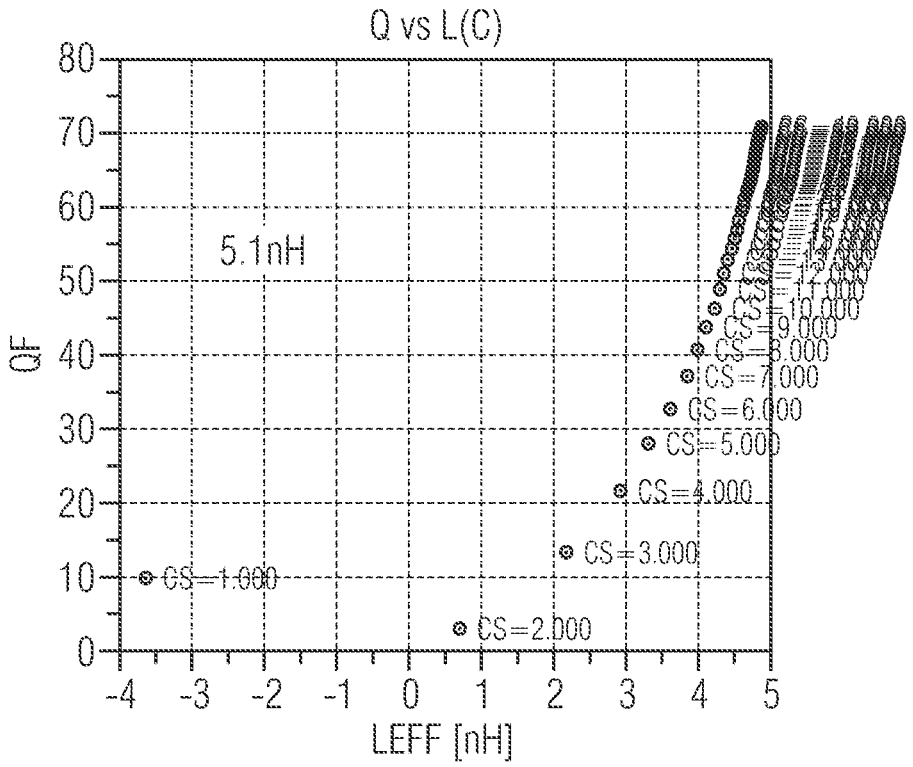
Figure 13D:
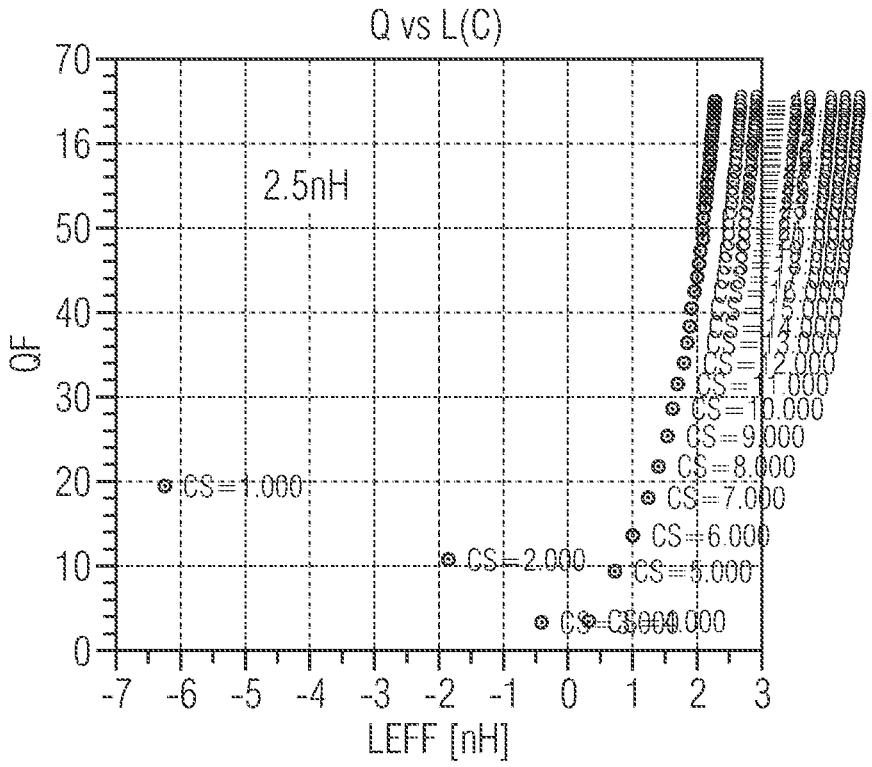

FIG. 9 shows, in a diagram simulation, results of the maximum voltage on the tuning capacitor plotted over the capacitance of the tuning capacitor operated as shown in FIG. 2. Thereby, the ordinate denotes the voltage over the tuning capacitor MAXVC3 in V, wherein the abscissa denotes the adjusted capacitance CS in pF.

As shown in FIG. 9, a combination of an inductor 104 having an inductance value L of 10 nH with variable capacitor 106 (or tuning capacitor) having a minimum capacitance value $C_{min}$ of 10 pF (700 MHz) avoids the low Q-factor (and resonance) region 150 which is characterized by a Q-factor equal to or smaller than 15, i.e., Q≤15, and an effective inductivity smaller than or equal to 5 nH, i.e., L≤5 nH. But rather, a minimum capacitance value $C_{min}$ of 10 pF leads to a Q-factor region 160 which is characterized by a Q-factor greater than 10, i.e., Q>10, or greater than 15, i.e., Q>15, and an effective inductivity greater than 5 nH, i.e., L>5 nH (compare points m6 and m7 in contrast to point m5 in FIG. 9).

Further, also if the variable capacitor 106 is bypassed and the inductor 104 is directly connected to the second terminal no of the antenna 102 (e.g., switch off position, e.g., via the further transistor chain 124_*n*+1 shown in FIG. 6), the low Q-factor region 150 can be avoided (compare point m4 in FIG. 9).

FIGS. 10A to 10D show in diagrams simulation results of the maximum voltage MAXVC3 over the tuning capacitor plotted over the capacitance of the tuning capacitor for four different inductance values L of the inductor 104. In FIGS. 10A to 10D, the ordinate denotes the voltage over the third capacitor MAXVC3 in V, wherein the abscissa denotes the capacitance CS in pF.

In other words, FIGS. 10A to 10D show test case results for the following parameters: 700 MHz, 34 dBm and VSWR12.

FIGS. 11A to 11D show, in diagrams, simulation results of the maximum voltage MAXVC3 over the third capacitor plotted over the capacitance of the third capacitor for four different inductance values L of the inductor 104. In FIGS. 11A to 11D, the ordinate denotes the voltage over the third capacitor MAXVC3 in V, wherein the abscissa denotes the capacitance CS in pF.

In other words, FIGS. 11A to 11D show test case results for the following parameters: 1,700 MHz, 31 dBm and VSWR12.

FIGS. 12A to 12D show in diagrams simulation results of the Q-factor plotted over the effective inductance $L_{EFF}$ of the series circuit comprising the inductor 104 and the variable capacitor 106 for four different inductance values L of the inductor 104 at 700 MHz. In FIGS. 12A to 12D the ordinate denotes the Q-factor, wherein the abscissa denotes the effective Inductance $L_{EFF}$ in nH.

FIGS. 13A to 13D show in diagrams simulation results of the Q-factor plotted over the effective inductance $L_{EFF}$ of the series circuit comprising the inductor 104 and the variable capacitor 106 for four different inductance values L of the inductor 104 at 1,700 MHz. In FIGS. 13A to 13D the ordinate denotes the Q-factor, wherein the abscissa denotes the effective Inductance $L_{EFF}$ in nH.

Figure 14A:
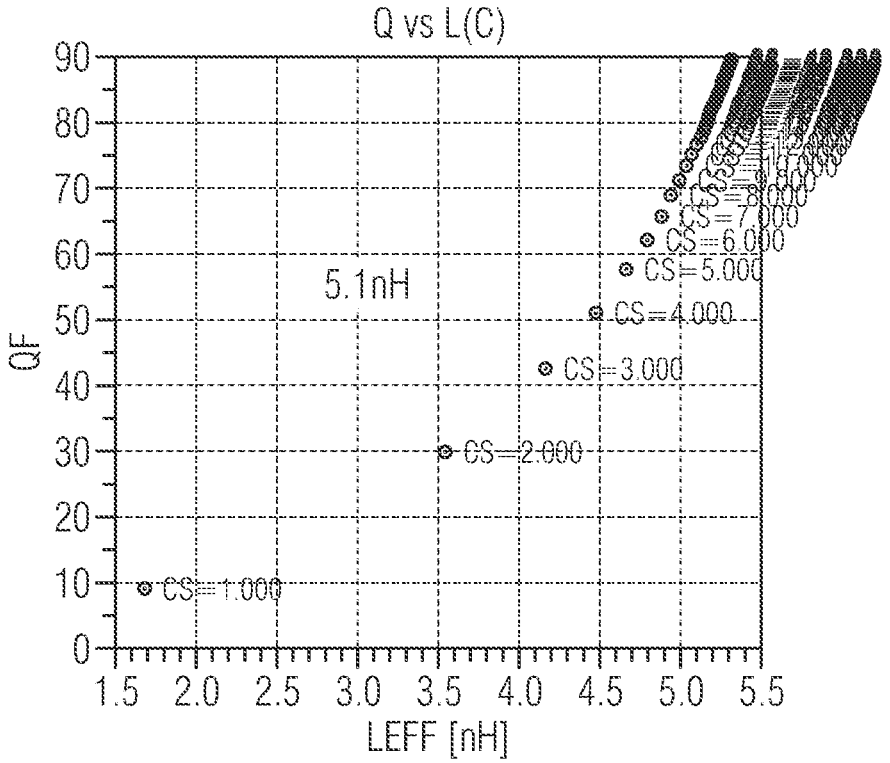
FIGS. 14A and 14B show in diagrams simulation results of the Q-factor plotted over the effective inductance of the series circuit comprising the inductor and the variable capacitance for two different inductance values of the inductor at 2,600 MHz.
Figure 14B:
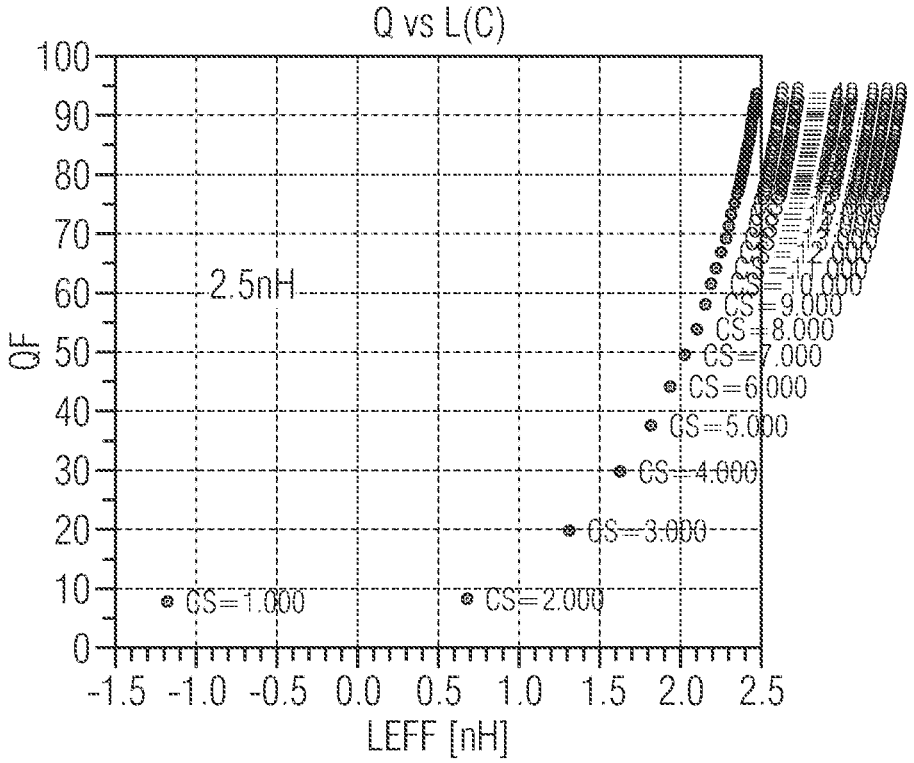

FIGS. 14A and 14B show, in diagrams, simulation results of the Q-factor plotted over the effective inductance $L_{EFF}$ of the series circuit comprising the inductor 104 and the variable capacitor 106 for two different inductance values L of the inductor 104 at 2,600 MHz. In FIGS. 13A to 13D the ordinate denotes the Q-factor, wherein the abscissa denotes the effective Inductance $L_{EFF}$ in nH.

Figure 15:
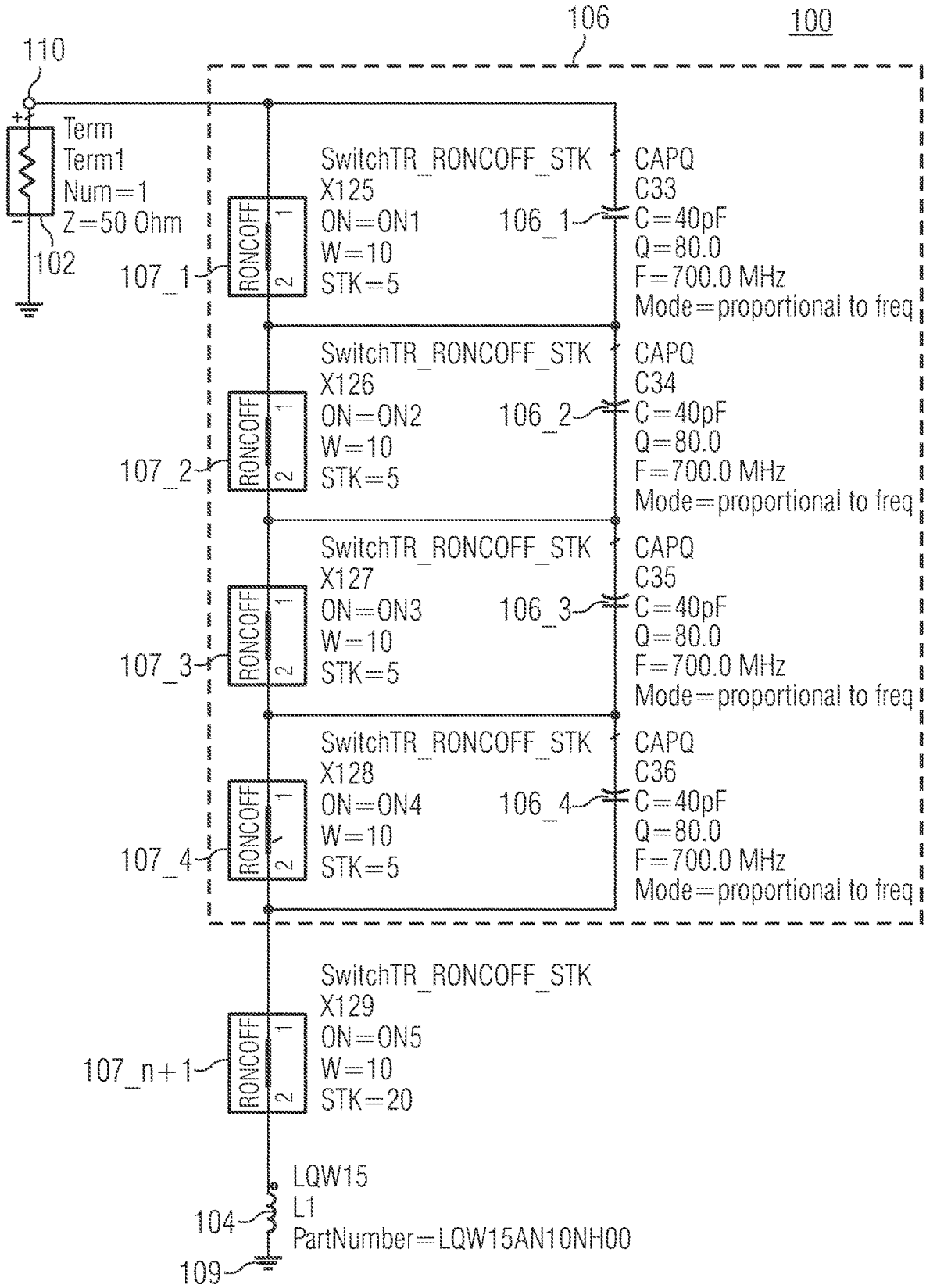
FIG. 15 shows a schematic circuit diagram of an antenna tuning circuit comprising an inductor, a variable capacitance and an antenna.

FIG. 15 shows a schematic circuit diagram of an antenna tuning circuit 100 comprising an inductor 104, a variable capacitor 106 and an antenna 102. The inductor 104 and the variable capacitor 106 can be connected in series between the second terminal no of the antenna 102 and a reference terminal 109 configured to provide a reference potential, such as a ground potential.

Note that in FIG. 15, the antenna 102 is illustrated by means of a 50 Ohm impedance.

As shown in FIG. 15, the variable capacitor 106 can be implemented by a plurality of capacitors 106_1 to 106_*n* (n=4) coupled in series between the second terminal 110 of the antenna 102 and the inductor 104, and a plurality of bypass switches 107_1 to **107_*n* (n=4) connected in parallel to the plurality of capacitors 106_1 to 106_*n*, such that each bypass switch of the plurality of bypass switches 107_1 to 107_*n* may bypass one capacitor of the plurality of capacitors 106_1 to 106_*n***.

For example, a first bypass switch 107_1 of the plurality of bypass switches 107_1 to **107_*n* may be connected in parallel to the first capacitor 106_1 of the plurality of capacitors 106_1 to 106_*n* in order to bypass the first capacitor 106_1**, for example, in dependence on an active antenna band.

Similarly, a second bypass switch 107_2 of the plurality of bypass switches 107_1 to **107_*n* may be connected in parallel to a second capacitor 106_2 of the plurality of capacitors 106_1 to 106_*n* in order to bypass the second capacitor 106_2**, for example, in dependence on an active antenna band.

Thereby, the plurality of capacitors 106_1 to **106_*n*** may comprise the same capacitance value.

Thus, the capacitance of the variable capacitor 106 can be varied (or adjusted) by varying (or adjusting) the number of capacitors of the plurality of capacitors 106_1 to **106_*n* that are connected effectively in series between the second terminal 110 of the antenna 102 and the inductor 104**.

Further, as shown in FIG. 15, a further switch **107_*n*+1 may be connected in series between the variable capacitor 106 and the inductor 104**.

Figure 16:
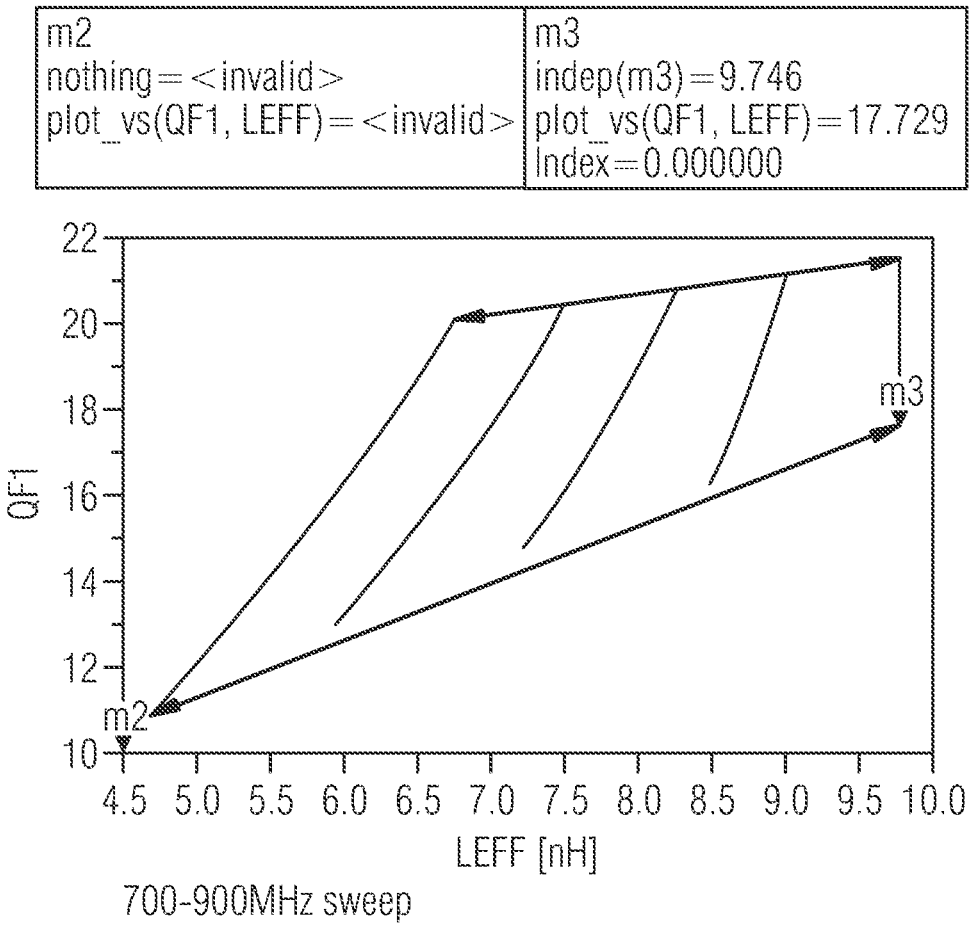
FIG. 16 shows in a diagram simulation results of the Q-factor of the series circuit comprising the inductor and the variable capacitance shown in FIG. 15 plotted over the effective inductance of the series circuit.

FIG. 16 shows, in a diagram simulation, results of the Q-factor of the series circuit comprising the inductor 104 and the variable capacitor 106 shown in FIG. 15 plotted over the effective inductance $L_{EFF}$ of the series circuit. Thereby, the ordinate denotes the Q-factor, wherein the abscissa denotes the effective inductance $L_{EFF}$ in nH.

The diagram shows the five switch states and their behavior over frequency. The five lines represent each one capacitance combination. In bypass (all transistors on) mode we obtain the 10 nH original value, whereas by successive decrease of capacitance the inductance reduces. As well, the Q factor drops. (This diagram incorporates a real transistor model so that the tunable capacitor is non-ideal.)

Figure 17:
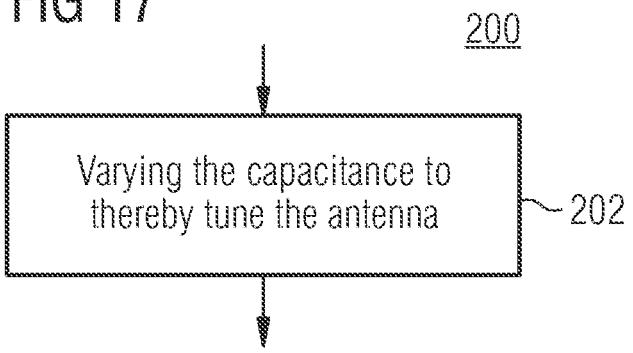
FIG. 17 shows a flow chart of a method for tuning an antenna.

FIG. 17 shows a flow chart of a method 200 for tuning an antenna. The antenna comprises a first terminal, which serves as a feed terminal, and a second terminal, which is separate from the first terminal, wherein an inductor and a variable capacitance are coupled to the second terminal. The method 200 comprises varying 202 the capacitance, to thereby tune the antenna.

Figure 18:
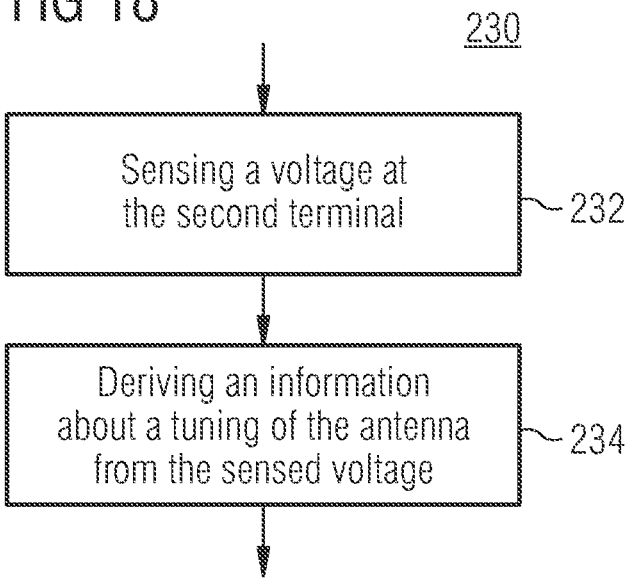
FIG. 18 shows a flow chart of a method for operating an antenna arrangement.

FIG. 18 shows a flow chart of a method 230 for operating an antenna arrangement. The antenna arrangement comprises an antenna with a first terminal, which serves as a feed terminal, and a second terminal, which is separate from the first terminal. The method 230 comprises sensing 232 a voltage at the second terminal, and deriving 234 information about a tuning of the antenna from the sensed voltage.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

What is claimed is:

1. An antenna arrangement comprising:

an antenna with a first terminal being a feed terminal and a second terminal separate from the first terminal; and an antenna tuning circuit connected in series between the second terminal and a reference terminal, wherein the antenna tuning circuit comprises an inductance, a variable capacitor and a resistor, and wherein the antenna arrangement is configured to sense a trimming voltage at the resistor so that the antenna arrangement is able to tune the trimming voltage by varying a capacitance of the variable capacitor based on the sensed trimming voltage.

2. The antenna arrangement according to claim 1, wherein the second terminal is arranged to the first terminal such that a second terminal's position corresponds with a half of an electrical length of the antenna.

3. The antenna arrangement according to claim 1, wherein the trimming voltage at the second terminal is less than 1 VEFF.

4. The antenna arrangement according to claim 1, wherein the antenna arrangement is configured to reduce the trimming voltage present at the second terminal by varying at least one of the variable capacitor or the inductance using a successive approximation.

5. The antenna arrangement according to claim 1, wherein a resistance value of the resistor is at least more than 10 times higher than an impedance of the antenna, and wherein the trimming voltage is sensed at this resistor.

6. The antenna arrangement according to claim 5, wherein the resistor comprises a resistance value between 250Ω and 7.5 kΩ.

7. The antenna arrangement according to claim 1, wherein the second terminal is arranged to the first terminal such that a second terminal's position corresponds with a quarter of an electrical length of the antenna.

8. The antenna arrangement according to claim 1, wherein the inductance is a variable inductance.

9. The antenna arrangement according to claim 1, further comprising a switch connecting the variable capacitor to a plurality of inductances, and wherein the inductance is one of the plurality of inductances.

10. The antenna arrangement according to claim 9, wherein the switch is a SinglePolexThrow (SPxT) switch.

11. The antenna arrangement according to claim 1, wherein the reference terminal is ground.

12. An antenna arrangement comprising:

an antenna with a first terminal being a feed terminal and a second terminal separate from the first terminal, the second terminal being arranged such that a second terminal's position corresponds with a half or a quarter of an electrical length of the antenna;

an inductor and a variable capacitor coupled in a series circuit between the second terminal and a reference terminal; and a sensor comprising a resistor and connected to the second terminal and the variable capacitor, wherein the sensor is configured to sense a trimming voltage at the resistor so that the trimming voltage is tunable by varying a capacitance of the capacitor based on the sensed trimming voltage at the second terminal.

13. The antenna arrangement according to claim 12, wherein a resistance value of the resistor is at least more than 10 times higher than an impedance of the antenna.

14. The antenna arrangement according to claim 13, wherein the resistor comprises a resistance value between 250Ω and 7.5 kΩ.

15. The antenna arrangement according to claim 12, wherein the inductor is a variable inductor.

16. The antenna arrangement according to claim 12, further comprising a switch connecting the variable capacitor to a plurality of inductors, wherein the inductor is one of the plurality of inductors, and wherein each of the plurality of inductors has a inductance different from other inductors of the plurality of inductors.

17. An antenna arrangement comprising:

an antenna comprising only two terminals, the two terminals being a feed terminal and a second terminal separate from the feed terminal; and an antenna tuning circuit connected in series between the second terminal and a reference terminal, wherein the antenna tuning circuit comprises an inductance, a variable capacitor and a resistor, and wherein the antenna arrangement is configured to sense a trimming voltage at the resistor so that the antenna arrangement is able to tune the trimming voltage by varying a capacitance of the variable capacitor based on the sensed trimming voltage.

* * * * *